US010463176B1

(12) United States Patent
Sells

(10) Patent No.: US 10,463,176 B1
(45) Date of Patent: Nov. 5, 2019

(54) ONE-PIECE SIDEKICK DISPLAY

(71) Applicant: Green Bay Packaging, Inc., Green Bay, WI (US)

(72) Inventor: Terry M. Sells, Schoolcraft, MI (US)

(73) Assignee: Green Bay Packaging, Inc., Green Bay, WI (US)

( * ) Notice: Subject to any disclaimer, the term of this patent is extended or adjusted under 35 U.S.C. 154(b) by 0 days.

(21) Appl. No.: 15/647,713

(22) Filed: Jul. 12, 2017

Related U.S. Application Data

(60) Provisional application No. 62/364,108, filed on Jul. 19, 2016.

(51) Int. Cl.

| | |
|---|---|
| ***A47F 5/11*** | (2006.01) |
| ***A47F 5/00*** | (2006.01) |
| ***B65D 5/52*** | (2006.01) |
| ***B65D 5/18*** | (2006.01) |
| ***B65D 5/20*** | (2006.01) |
| ***B65D 5/30*** | (2006.01) |

(52) U.S. Cl.
CPC ..... *A47F 5/116* (2013.01); *A47F 5/0018* (2013.01); *A47F 5/114* (2013.01); *B65D 5/18* (2013.01); *B65D 5/2052* (2013.01); *B65D 5/307* (2013.01); *B65D 5/308* (2013.01); *B65D 5/522* (2013.01)

(58) Field of Classification Search
CPC ..... A47F 5/116; A47F 5/018; A47F 5/114; A47F 5/112; A47F 5/108; A47F 5/10; A47F 5/11; A47F 5/0018; B65D 5/18; B65D 5/2052; B65D 5/307; B65D 5/308; B65D 5/522; A47B 43/02; A47B 55/06; A47B 47/06
USPC ..... 248/174, 150, 152
See application file for complete search history.

(56) References Cited

U.S. PATENT DOCUMENTS

| | | | | |
|---|---|---|---|---|
| 2,277,807 | A * | 3/1942 | Whitestone | A47F 5/116 108/99 |
| 5,706,953 | A * | 1/1998 | Polvere | A47F 5/116 206/736 |
| 8,485,370 | B2 | 7/2013 | Dewhurst | |
| 8,857,633 | B2 | 10/2014 | Dewhurst | |
| 9,907,414 | B2 * | 3/2018 | Heuer | A47B 43/00 |
| 2006/0151407 | A1 * | 7/2006 | Virvo | A47F 5/116 211/72 |
| 2011/0049072 | A1 * | 3/2011 | Dewhurst | A47F 5/116 211/135 |
| 2018/0042405 | A1 * | 2/2018 | Lilja | A47B 43/02 |
| 2018/0160825 | A1 * | 6/2018 | Abel | A47F 5/116 |
| 2018/0293919 | A1 * | 10/2018 | Ertl | G09F 7/18 |

* cited by examiner

*Primary Examiner* — Christopher Garft
(74) *Attorney, Agent, or Firm* — Boyle Fredrickson, S.C.

(57) ABSTRACT

A display having a front wall, a back wall oriented parallel to the front wall, sidewalls disposed between the front wall and back wall and oriented perpendicular thereto, and a display segment coupled to one of the sidewalls and transitionable between a display position and a shipping position.

14 Claims, 13 Drawing Sheets

ONE-PIECE SIDEKICK DISPLAY

CROSS-REFERENCE TO RELATED APPLICATIONS

This application claims priority to U.S. Provisional Application No. 62/364,108, filed Jul. 19, 2016, the entire contents of which are hereby expressly incorporated by reference into this application.

BACKGROUND OF THE INVENTION

The present invention relates to a corrugated one-piece sidekick display and, more particularly, to a sidekick display having a shipping position for storage and transportation and a display position for displaying and advertising products within the display during commercial use.

Sidekick displays are routinely used in a retail environment to provide both an area for storing products and an area for advertising the product stored within the sidekick display, or for advertising other or related products or services. A typical sidekick display has a product containing structure on one side and a separate printed structure, commonly known as a sidekick, on the other side, which during use are positioned in a side-by-side configuration. In a common application, the product side has a number of shelves or bins within which products are placed. The side-by-side printed structure and product containing structure, within which products are placed, is then placed into a shipping container for shipment to a retailer, distributor or the like. During shipping the sidekick display risks being damaged unless protected by the separate shipping container.

As such, there is a need for a sidekick display that includes a printed structure or display segment that transitions between a display position and a transportation position. The display position presents advertisement for the product to be sold or for related products or services, while the transportation position encloses the product containing structure, such as shelving, of the sidekick display to protect the sidekick display during shipping and handling.

In addition, when transitioning from the display position to the transportation position, the sidekick display of the present invention decreases its overall volume in half. This reduces the space required during shipping and storage, and allows for more sidekick displays to be shipped in a single delivery.

SUMMARY OF THE INVENTION

The invention is directed to a corrugated one-piece sidekick display for protecting the display during storage and transportation in one position and displaying advertising for products stored within the display during commercial use.

According to an embodiment of the invention, a sidekick display includes a front wall, a back wall oriented parallel to the front wall, sidewalls disposed between the front wall and back wall and oriented perpendicular thereto, and a display segment coupled to one of the sidewalls and transitionable between a display position and a shipping position.

According to another embodiment of the invention, a blank for a display includes a wall segment having a number of portions, a display segment having a number of portions, the display segment extending from the wall segment and separated from the wall segment by way of a display fold line, and a shelf segment having a number of portions, the shelf segment extending from the wall segment and separate from the wall segment by way of a shelf fold line. The number of portions of the wall segment form a back wall and at least one side wall of the display. Further, the number of portions of the shelf segment form a front wall, at least one side wall, and at least one shelf of the display. In addition, the number of portions of the display segment are transitionable between a display position and a shipping position.

According to yet another embodiment of the invention, a method of forming a display includes providing a blank having a wall segment with a number of portions, a display segment with a number of portions, and a shelf segment with a number of portions. The number of portions of the wall segment, display segment, and shelf segment are separated by a number of fold lines. The method further includes folding the number of portions of the wall segment along the fold lines to form a back wall and at least one side wall of the display, folding the number of portions of the shelf segment along the fold lines to form a front wall, at least one side wall, and at least one shelf of the display, and folding the number of portions of the display segment along the fold lines into one of a display position and a shipping position. The display segment is transitionable between the display position and the shipping position.

These and other aspects and objects of the present invention will be better appreciated and understood when considered in conjunction with the following description and the accompanying drawings. It should be understood, however, that the following description, while indicating representative embodiments of the present invention, is given by way of illustration and not limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention will become more readily apparent by referring to the exemplary, and therefore non-limiting, embodiments illustrated in the drawings accompanying and forming a part of this specification, wherein like reference numerals designate the same elements in the several views.

In the drawings.

DETAILED DESCRIPTION OF THE DRAWINGS

The present invention and the various features and advantageous details thereof are explained more fully with reference to the non-limiting embodiments described in detail in the following description.

Figure 1:
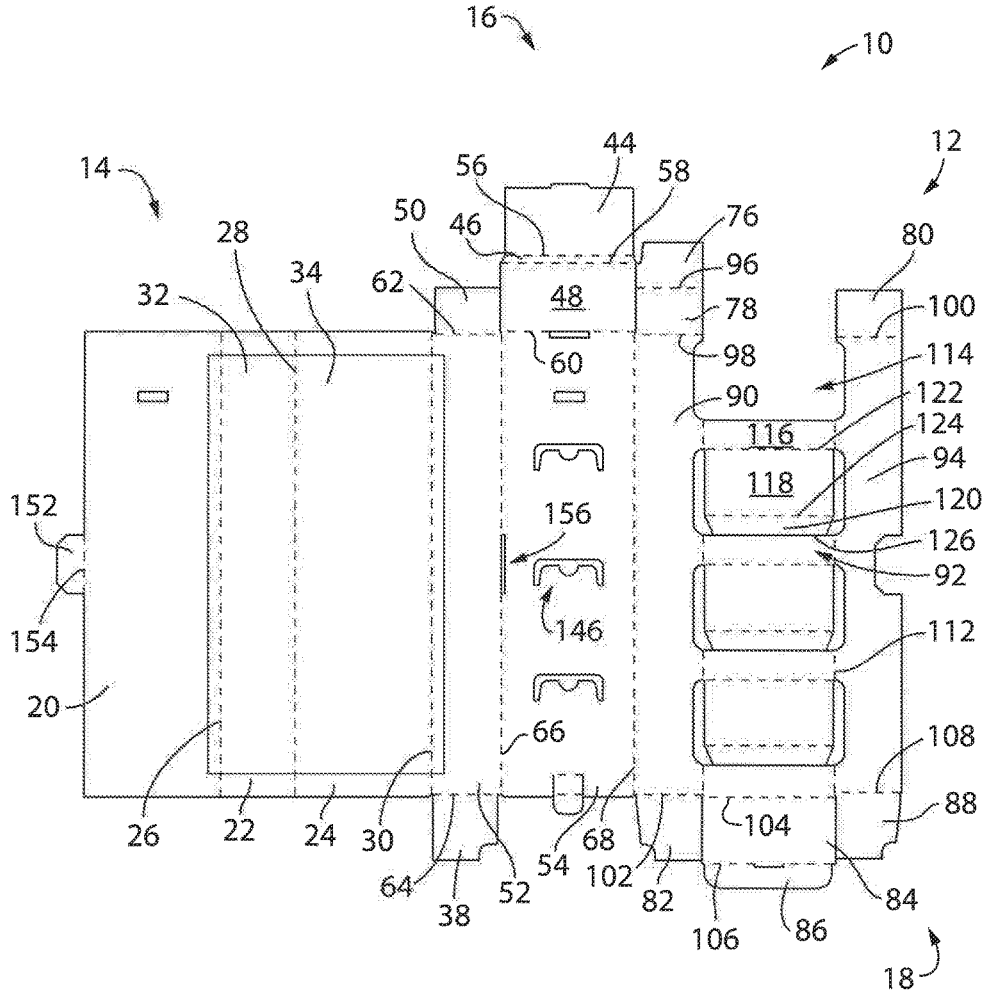
FIG. 1 is a side view of a one-piece sidekick display in an unfolded position, according to an embodiment of the invention.

Referring first to FIG. 1, a side view of a one-piece sidekick display 10 is shown in an unfolded position 12. The one-piece sidekick display 10 includes a first segment 14, a second segment 16, and a third segment 18, also referred to as a display segment 14, a wall segment 16, and a shelf segment 18. Embodiments of the invention contemplate display 10 being constructed from material such as corrugated board, cardboard, fiber board, or any similar material suitable known in the art.

As shown in FIG. 1, the display segment 14 of the display 10 includes a first portion 20, a second portion 22, and a third portion 24. While the representative embodiment illustrates the use of three (3) portions 20, 22, 24, the invention is not limited as such and the display segment 14 of the display 10 may include more or less than three (3) portions. The first portion 20 and the second portion 22 are separated by a first fold line 26, and the second portion 22 and the third portion 24 are separated by a second fold line 28. In addition, the display segment 14 is separated from the wall segment 16 by a display fold line 30. The display segment 14 may also include a graphic 32. As depicted in the representative embodiment of the invention, the graphic 32 is located on a front side 34 of the display segment 14, and in particular the second portion 22 and the third portion 24 of the display segment 14. However, in alternative embodiments of the invention, the graphic 32 may be located on any side or any portion of the display segment 14.

The wall segment 16 of the display 10 includes a number of top portions, bottom portions, and wall portions, which when in a folded position 42 assist with forming the top 134, bottom 136, back wall 144, and side walls 138, 140 of the display 10. In the representative embodiment of the invention, the top portions of the wall segment 16 include a first top portion 44, a second top portion 46, a third top portion 48, and a fourth top portion 50. However, it is contemplated that the wall segment 16 of the display may include any number of top portions. As will be described in further detail later, the number of top portions form the top of the display 10 when the display 10 is in the folded position 42.

In the representative embodiment of the invention, the bottom portions of the wall segment 16 include one (1) bottom portion 38. However, alternative embodiments of the invention may have more than one (1) bottom portion. FIG. 1 also shows the wall portions of the wall segment 16 including a first wall portion 52 and a second wall portion 54. While the representative embodiment of the invention shows two (2) wall portions, it is contemplated that more or less than two (2) wall portions may be used, As shown in FIG. 1, the first top portion 44 is separated from the second top portion 46 by way of a first fold line 56, and the second top portion 46 is separated from the third top portion 48 by way of a second fold line 58. Further, the third top portion 48 is separated from the second wall portion 54 by way of a third fold line 60, the fourth top portion 50 is separated from the first wall portion 52 by way of a fourth fold line 62, and the bottom portion 38 is separated from the first wall portion 52 by way of a fifth fold line 64. The first wall portion 52 is separated from the second wall portion 54 by way of a sixth fold line 66.

The shelf segment 18 of the display 10 is separated from the wall segment 16 by way of the shelf fold line 68. In addition, the shelf segment 18 includes a number of top portions, bottom portions, and shelf portions, which when in the folded position 42 assist with forming the top 134, bottom 136, side walls 138, 140, and front wall 162. While FIG. 1 depicts the shelf segment 18 having a first top portion 76, a second top portion 78, and a third top portion 80, it is contemplated that more or less than three (3) top portions may be used. The bottom portions of the shelf segment 18 includes a first bottom portion 82, a second bottom portion 84, a third bottom portion 86, and a fourth bottom portion 88, However, it is contemplated that the shelf segment 18 may have more or less than four (4) bottom portions. The shelf portions include a first shelf portion 90, a second shelf portion 92, and a third shelf portion 94. While the representative embodiment of the invention has three (3) shelf portions, alternative embodiments of the invention may use more or less than three (3) shelf portions.

In the illustrated embodiment, the first top portion 76 is separated from the second top portion 78 by way of a first fold line 96, the second top portion 78 is separated from the first shelf portion 90 by way of a second fold line 98, and the third top portion 80 is separated from the third shelf portion 94 by way of a third fold line 100. In addition, the first shelf portion 90 is separated from the first bottom portion 82 by way of a fourth fold line 102, the second bottom portion 84 is separated from the second shelf portion 92 by way of a fifth fold line 104, the second bottom portion 84 is separated from the third bottom portion 86 by way of a sixth fold line 106, and the fourth bottom portion 88 is separated from the third shelf portion 94 by way of a seventh fold line 108. Additionally, the first shelf portion 90 is separated from the second shelf portion 92 by way of an eighth fold line 110, and the second shelf portion 92 is separated from the third shelf portion 94 by way of a ninth fold line 112.

Further, the second portion 92 of the shelf segment 18 includes a number of elements which assist with forming the shelves of the display 10 when the display 10 is in the folded position 42. As shown in FIG. 1, the second portion 92 includes a number of shelf openings 114, a number of shelf fronts 116, a number of shelf bottoms 118, and a number of shelf tabs 120. In particular, the representative embodiment of the invention has four (4) shelf openings 114, four (4) shelf fronts 116, three (3) shelf bottoms 118, and three (3) shelf tabs 120. However, alternative embodiments of the invention may have any number n of shelf openings 114 and shelf fronts 116, while having any number of n−1 shelf bottoms 118 and shelf tabs 120.

As shown in FIG. 1, when the display 10 is in the unfolded position 12, each of the shelf bottoms 118 and shelf tabs 120 are disposed within a respective one of the shelf openings 114. Each shelf bottom 118 is separated from an adjacent shelf front 116 by way of a first shelf fold line 122, and each shelf tab 120 is separated from an adjacent shelf bottom 118 by way of a second shelf fold line 124. In addition, each shelf tab 120 is separated from an adjacent shelf front 116 by way of a cut line 126, which also allows the shelf tab 120 to be detached from the adjacent shelf front 116 at a later point in construction.

Figure 2:
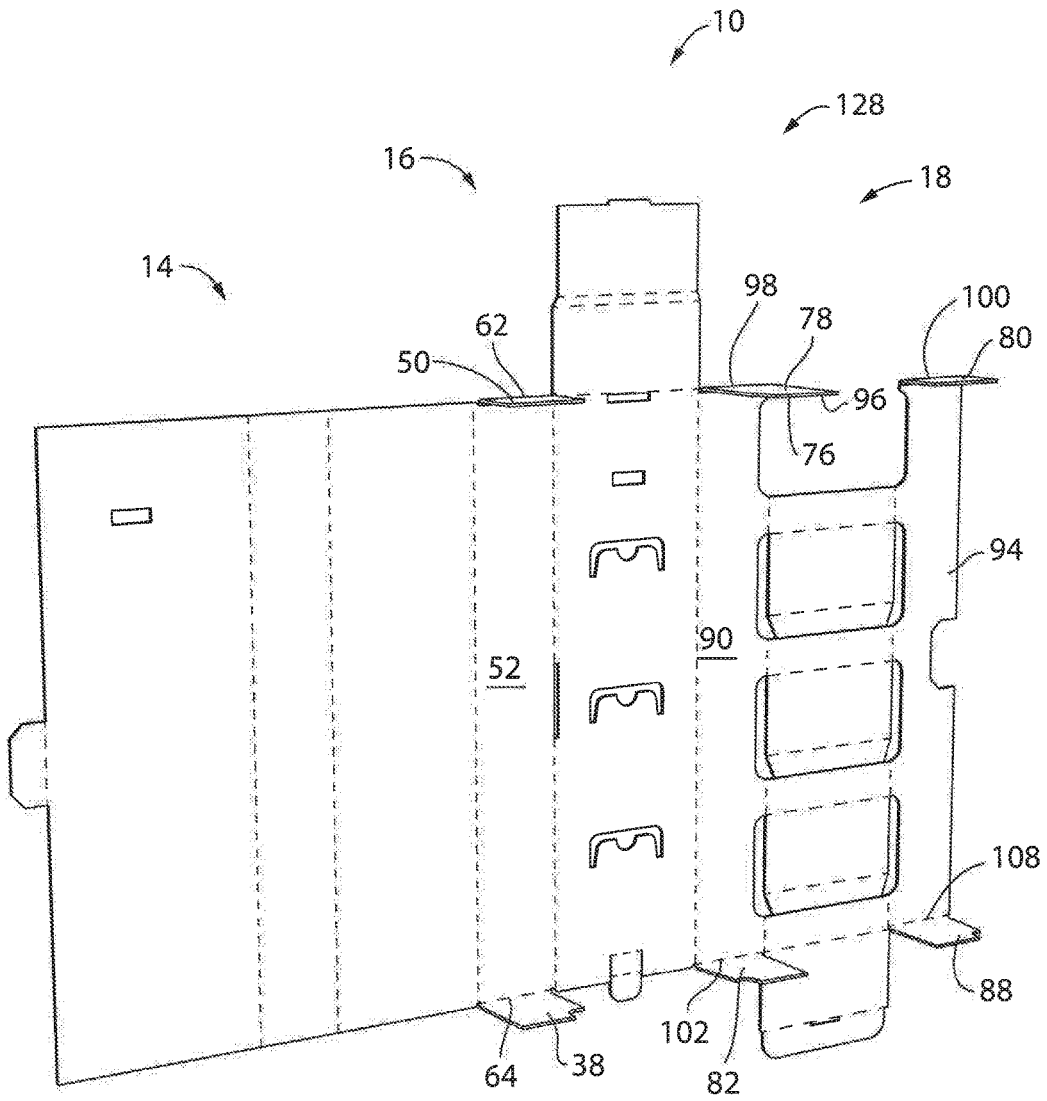
FIG. 2 is a front perspective view of the one-piece sidekick display of FIG. 1 in a first partially folded position.
Figure 3:
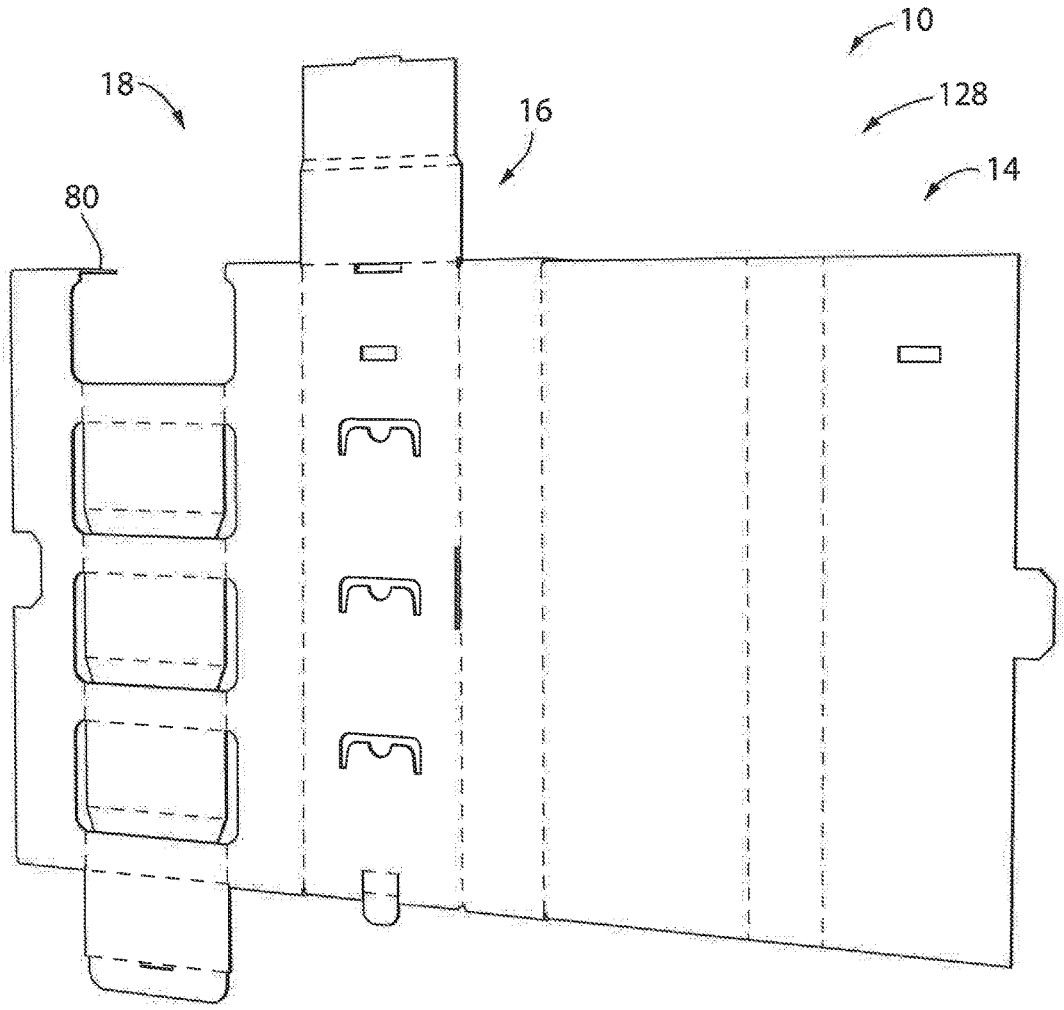
FIG. 3 is a rear perspective view of the one-piece sidekick display of FIG. 1 in the first partially folded position.

Now referring to FIGS. 2 and 3, front and rear perspective views, respectively, of the display 10 are shown in a partially folded position 128. As shown in FIGS. 2 and 3, top portion 50 of the wall segment 16 has been folded at a 90 degree angle along fold line 62, bottom portion 38 of the wall segment 16 has been folded at a 90 degree angle along fold line 64, top portion 78 of the shelf segment 18 has been folded at a 90 degree angle along fold line 98, top portion 80 of the shelf segment 18 has been folded at a 90 degree angle along fold line 100, top portion 76 of the shelf segment 18 has been folded at approximately a 180 degree angle along fold line 96, bottom portion 82 of the shelf segment 18 has been folded at a 90 degree angle along fold line 102, and bottom portion 88 of the shelf segment 18 has been folded at a 90 degree angle along fold line 108. As a result, top portion 50 and bottom portion 38 of the wall segment 16 are oriented perpendicular to wall portion 52 of the wall segment 16, top portion 78 and bottom portion 82 of the shelf segment 18 are oriented perpendicular to shelf portion 90 of the shelf segment 18, top portion 80 and bottom portion 88 are oriented perpendicular to shelf portion 94 of the shelf segment 18, and top portion 76 of the shelf segment 18 is oriented substantially parallel to top portion 78 of the shelf segment 18.

Figure 4:
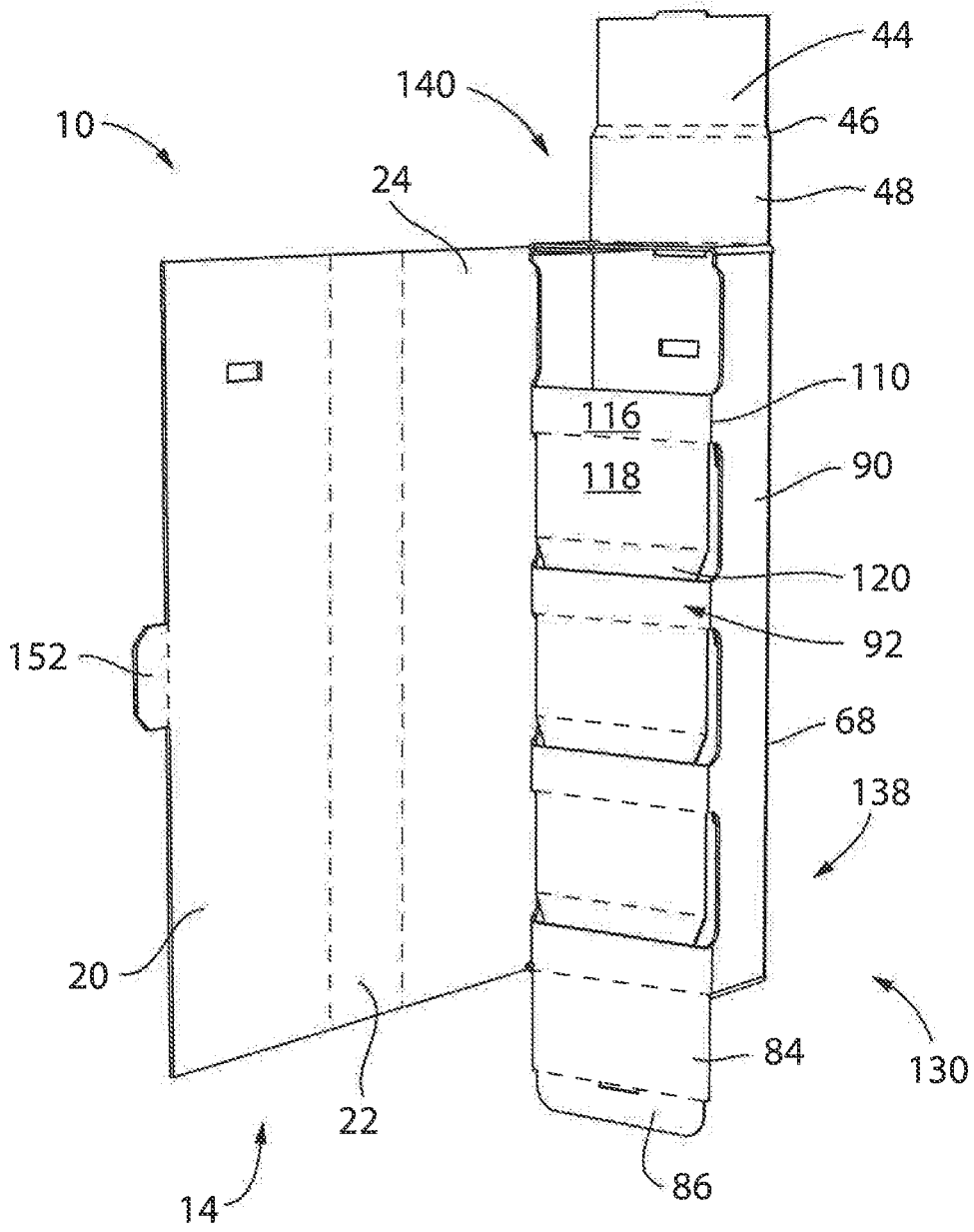
FIG. 4 is a front perspective view of the one-piece sidekick display of FIG. 1 in a second partially folded position.

FIG. 4 depicts the display 10 in another partially folded position 130. Here, wall portion 54 of the wall segment 16 has been folded 90 degrees along fold line 66, shelf portion 90 of the shelf segment 18 has been folded 90 degrees along fold line 68, shelf portion 92 of the shelf segment 18 has been folded 90 degrees along fold line 110, and shelf portion 94 of the shelf segment 18 has been folded 90 degrees along fold line 112. As a result, wall portion 54 of the wall segment 16 is oriented perpendicular to wall portion 52 of the wall segment 16, shelf portion 90 of the shelf segment 18 is oriented perpendicular to wall portion 54 of the wall segment 16 and parallel to the wall portion 52 of the wall segment 16, shelf portion 92 of the shelf segment 18 is oriented perpendicular to shelf portion 90 of the shelf segment 18 and parallel to wall portion 54 of the wall segment 16, and shelf portion 94 of the shelf segment 18 is oriented perpendicular to shelf portion 92 of the shelf segment 18 and parallel to shelf portion 90 of the shelf segment 18 and wall portion 52 of the wall segment 16. As shown in FIG. 4, shelf portion 90 forms a first side wall 138 of the display 10, and shelf portion 94 and wall portion 52 form a second side wall 140 of the display 10.

Figure 5:
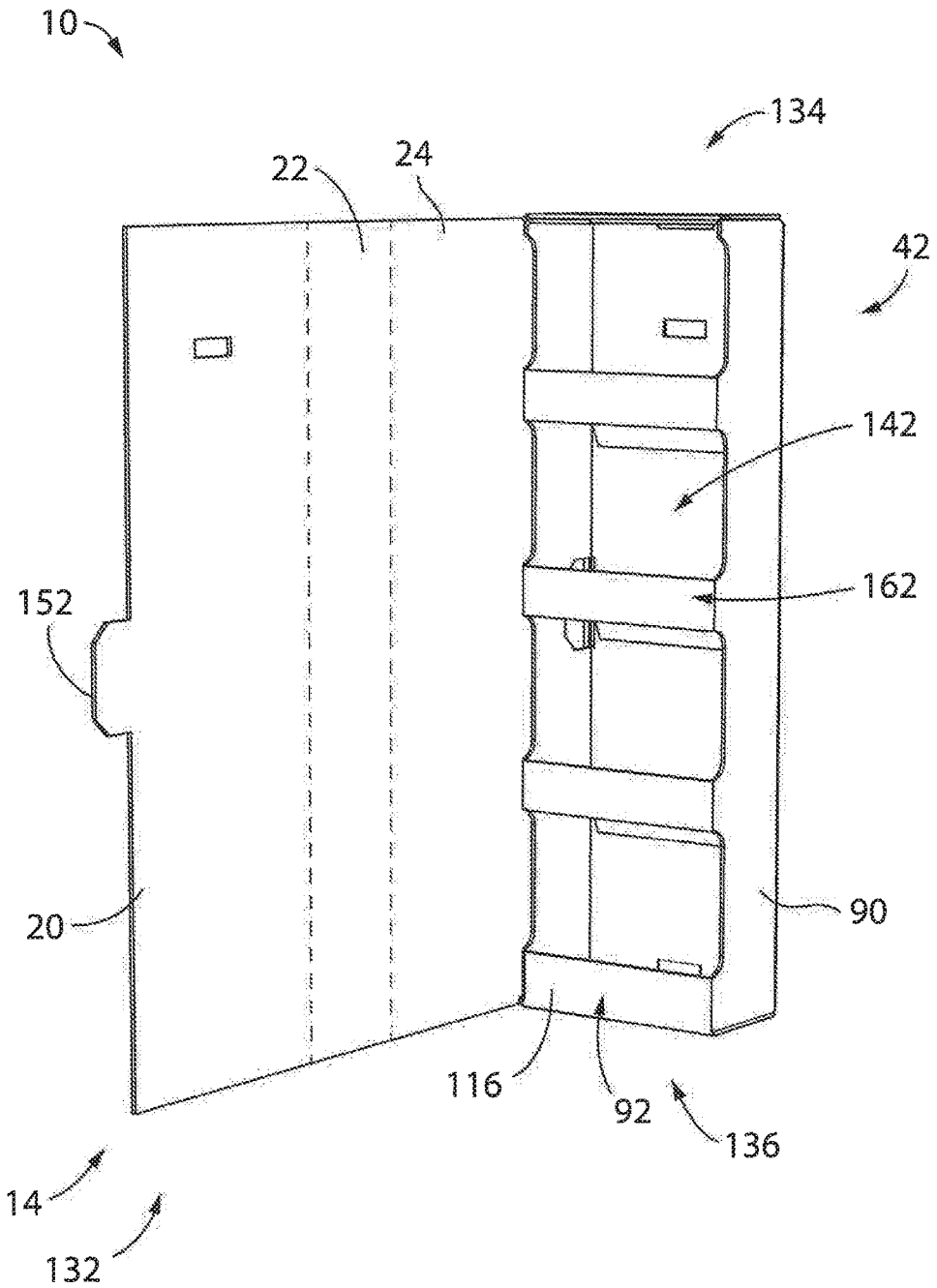
FIG. 5 is a front perspective view of the one-piece sidekick display of FIG. 1 in a third partially folded position.

Referring to FIG. 5, a front perspective view of the display 10 is shown in the folded position 42 with the display segment 14 in a neutral position 132. As shown in FIG. 5, top portion 48 of the wall segment 16 has been folded at a 90 degree angle along fold line 60, top portion 46 of the wall segment 16 has been folded at a 90 degree angle along fold line 58, and top portion 44 of the wall segment 16 has been folded at a 90 degree angle along fold line 56. As a result, top portion 48 of the wall segment 16 is oriented perpendicular to wall portion 54 of the wall segment 16, top portion 46 of the wall segment 16 is oriented perpendicular to top portion 48 of the wall segment 16 and parallel to wall portion 54 of the wall segment 16, and top portion 44 of the wall segment 16 is oriented perpendicular to top portion 46 of the wall segment 16 and parallel to top portion 48 of the wall segment 16. In turn, top portions 44, 46, 48, in conjunction with top portions 50, 76, 78, 80, form the top 134 of the display 10.

Additionally, bottom portion 84 of the shelf segment 18 is folded at a 90 degree angle along fold line 104, and bottom portion 86 of the shelf segment 18 is folded at a 90 degree angle along fold line 106. As such, bottom portion 84 of the shelf segment 18 is oriented perpendicular to shelf portion 92 of the shelf segment 18, and bottom portion 86 of the shelf segment 18 is oriented perpendicular to bottom portion 84 of the shelf segment 18 and parallel to the shelf portion 92 of the shelf segment 18. In turn, bottom portions 84, 86, in conjunction with bottom portions 38, 82, 88, form the bottom 136 of the display 10.

FIG. 5 also depicts the construction of a number of shelves 142. While bottom portion 84 in conjunction with the lowest shelf front 116 forms the lowest shelf of the shelves 142, the remainder of the shelves 142 are formed by detaching each shelf tab 120 from an adjacent shelf front 116 along the respective cut line 126, and folding each shelf bottom 118 at a 90 degree angle along adjacent fold line 122, so that each shelf bottom 118 is perpendicular to an adjacent shelf front 116. Also, each shelf tab 120 is folded at a 90 degree angle along adjacent fold line 124, so that each shelf tab 120 is perpendicular to an adjacent shelf bottom 118 and parallel to an adjacent shelf front 116 and wall portion 54 of the wall segment 16, which forms the back wall 144 of the display 10. In the representative embodiment of the invention, wall portion 54 of the wall segment 16 includes a. respective slot 146 for each shelf tab 120. As such, each shelf tab 120 is configured to interfit with a respective slot 146 to lock in place and complete construction of the shelves 142. In addition, shelf fronts 116 assist with forming front wall 162 of the display 10.

Figure 6:
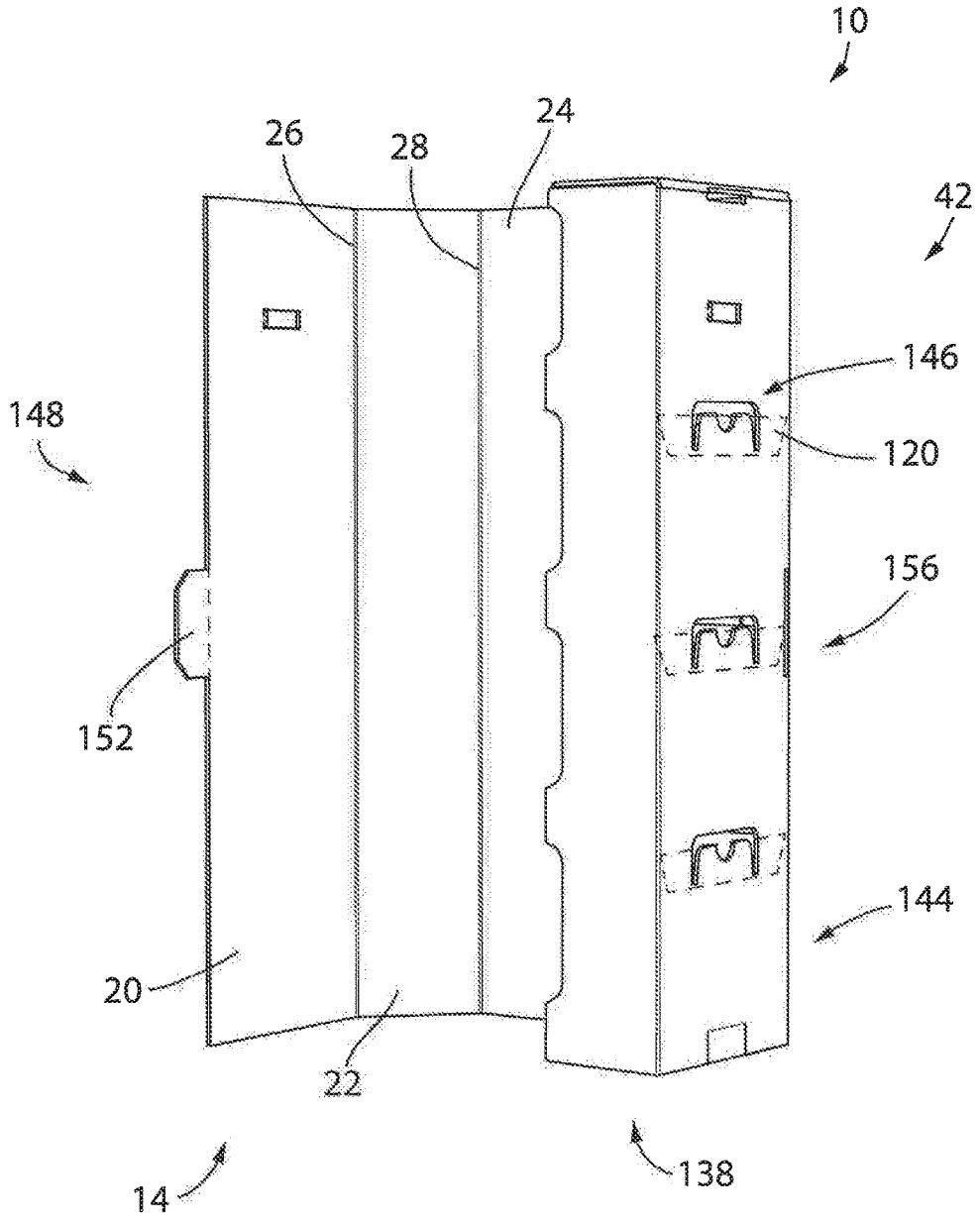
FIG. 6 is a rear perspective view of the one-piece sidekick display of FIG. 1 in a fourth partially folded position.

Now referring to FIG. 6, a rear perspective view of the display 10 is shown in the folded position 42 with the display segment 14 in a transition position 148 between the neutral position 132 and a shipping position 150. In this position, portion 20 of the display segment 14 is folded along fold line 26, portion 22 of the display segment 14 is being folded along fold line 28, and portion 24 of the display segment 14 is being folded along fold line 30.

Figure 7:
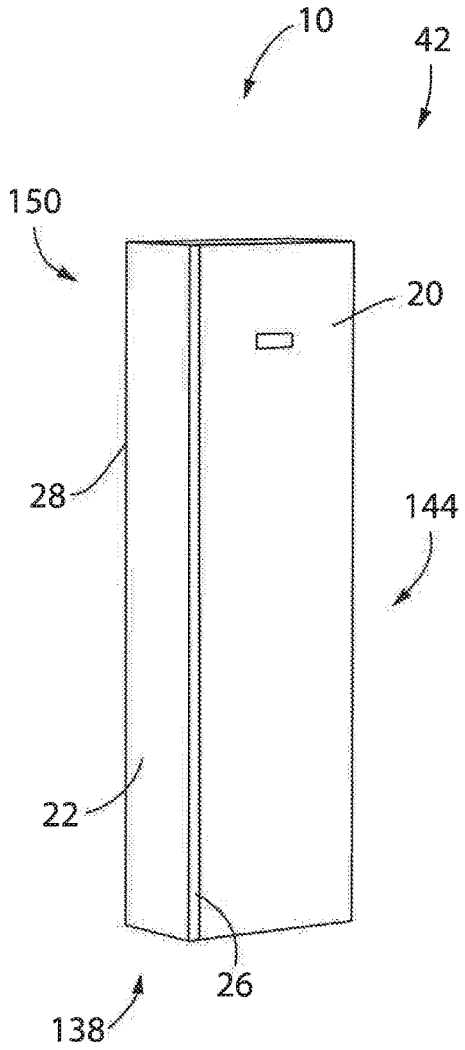
FIG. 7 is a rear perspective view of the one-piece sidekick display of FIG. 1 in a shipping orientation.
Figure 8:
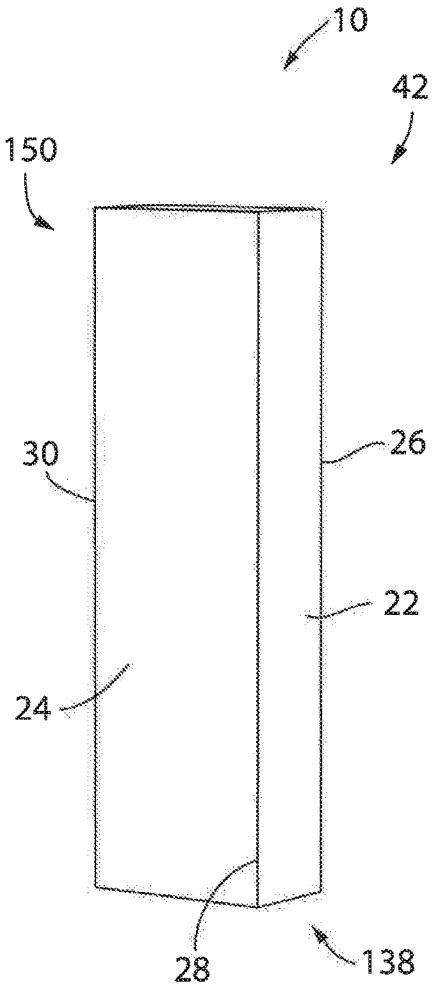
FIG. 8 is a front perspective view of the one-piece sidekick display of FIG. 1 in the shipping orientation.

FIGS. 7 and 8 depict rear and front perspective views, respectively, of the display 10 in the folded position 42 with the display segment 14 in the shipping position 150. As shown in FIGS. 7 and 8, portion 24 of the display segment 14 has been folded at a 90 degree angle along adjacent fold line 30, portion 22 of the display segment 14 has been folded at a 90 degree angle along adjacent fold line 28, and portion 20 of the display segment 14 has been folded at a 90 degree angle along adjacent fold line 26. As such, portion 24 of the display segment 14 is oriented parallel to front wall 162 and perpendicular to side wall 140, portion 22 of the display segment 14 is oriented perpendicular to portion 24 of display segment 14 and parallel to side wall 138, and portion 20 of the display segment 14 is oriented perpendicular to portion 22 of the display segment 14 and side wall 138 and parallel to back wall 144. In order to secure the display segment 14 in the shipping position 150, the display segment 14 includes a locking tab 152 separated from portion 20 by way of a tab fold line 154. The locking tab 152 is configured to interlock with a locking slot 156 formed in portion 54 of the wall segment 16, which in turn is the back wall 144 of the display 10.

Consequently, shelves 142 are completely enclosed within display 10 and therefore protected during shipping, as portion 24 of display segment 14 is in contact with the front wall 162 of the display 10. In one embodiment of the invention, shelves 142 may be preloaded with product prior to shipping. In this instance, the shipping position 150 of the display segment 14 ensures that the product is contained and protected during shipping.

Figure 9:
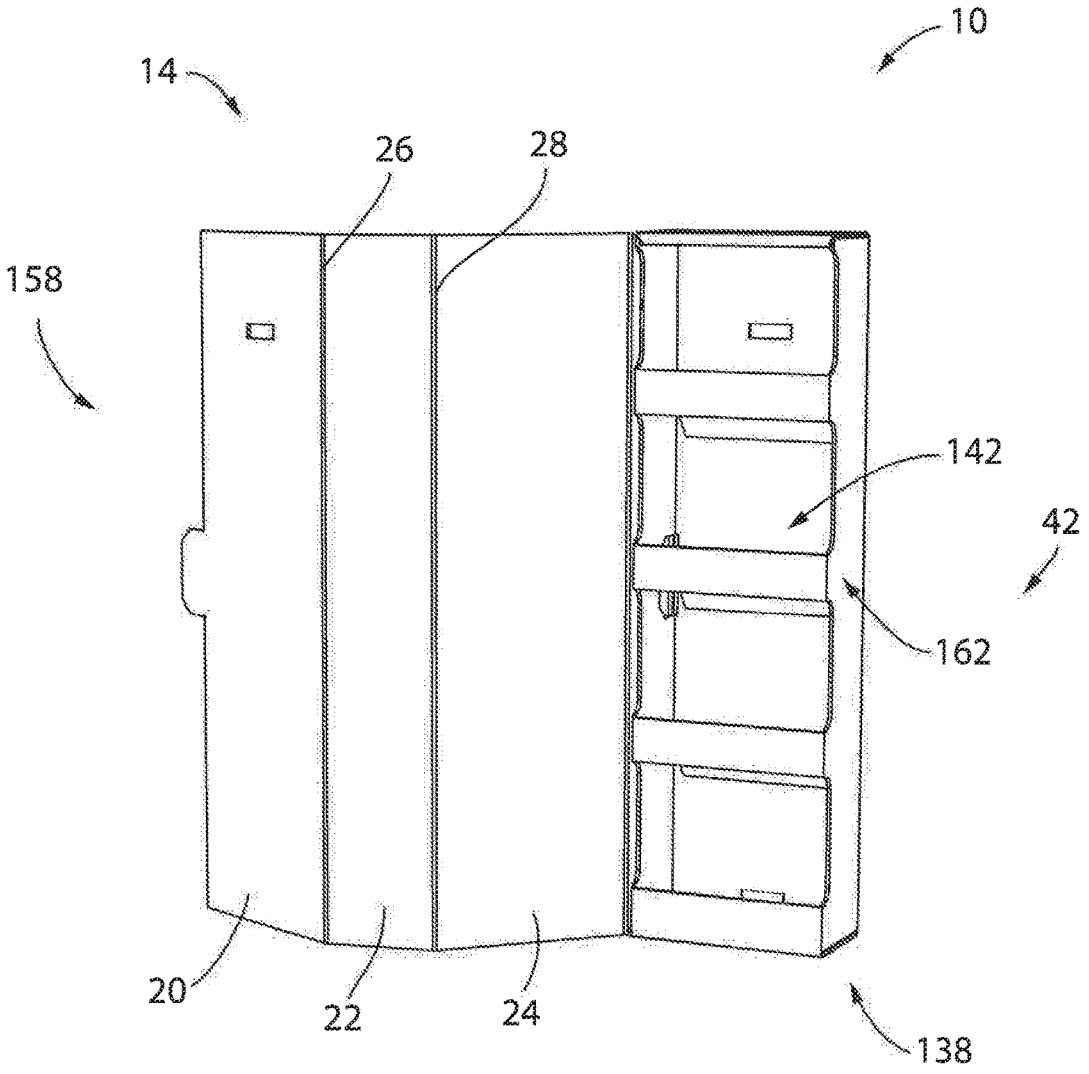
FIG. 9 is a front perspective view of the one-piece sidekick display of FIG. 1 in a transition position between the shipping orientation and a display orientation.

Referring to FIG. 9, a front perspective view of the display 10 is shown in the folded position 42 with the display segment 14 in a transition position 158 between the shipping position 150 and a display position 160. Here, portion 24 of the display, segment 14 is folded in the opposite direction along fold line 30, portion 22 of the display segment 14 is folded in the opposite direction along fold line 28, and portion 20 of the display segment 14 is folded in the opposite direction along fold line 26. As such, the display segment 14 is unfolded from the shipping position 150.

Figure 10:
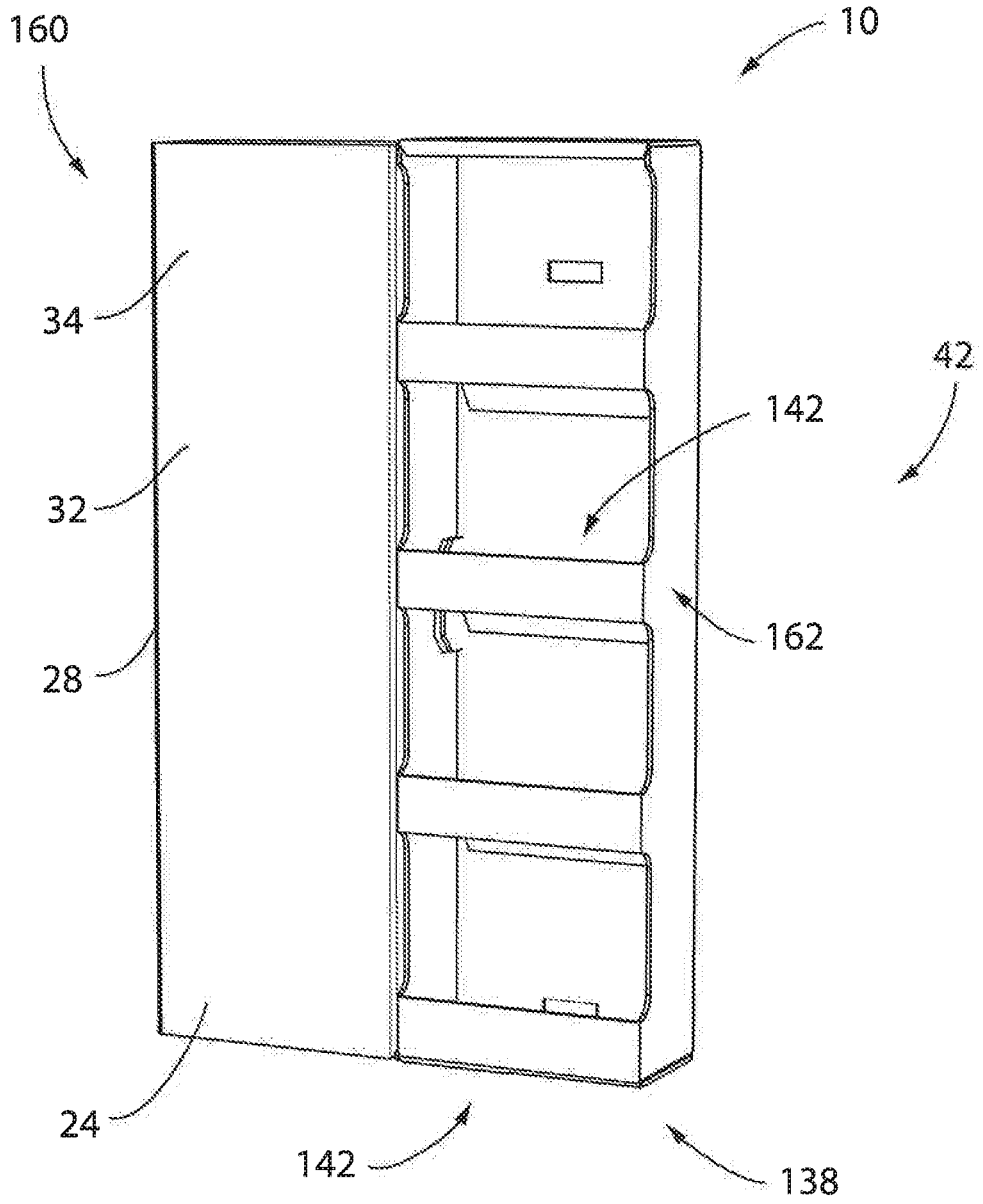
FIG. 10 is a front perspective view of the one-piece sidekick display of FIG. 1 in a display orientation.
Figure 11:
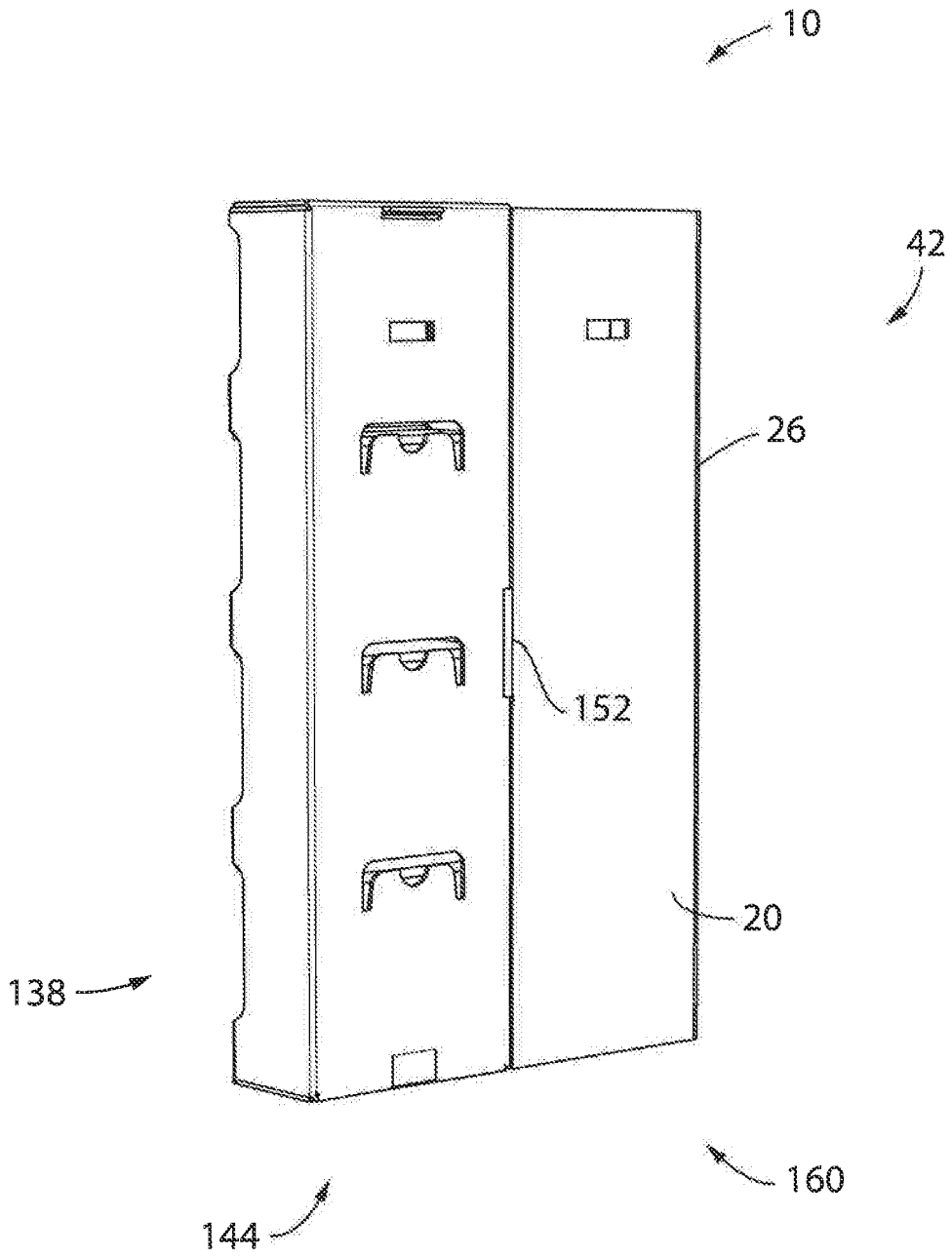
FIG. 11 is a rear perspective view o the one-piece sidekick display of FIG. 1 in the display orientation.

Referring to FIGS. 10 and 11, front and rear perspective views, respectively, of the display 10 are shown in the folded position 42 with the display segment 14 in the display position 160. Portion 24 of the display segment 14 is folded at a 90 degree angle along fold line 30, portion 22 of the display segment 14 is folded at a 90 degree angle along fold line 28, and portion 20 of the display segment 14 is folded at a 90 degree angle along fold line 26. As a result, portion 24 of the display segment 14 is oriented parallel to front wall 162 and perpendicular to side wall 140, portion 22 of the display segment 14 is oriented perpendicular to portion 24 of the display segment 14 and parallel to side wall 140, and portion 20 of the display segment 14 is oriented perpendicular to portion 22 of the display segment 14 and side wall 140. In order to secure the display segment 14 in the display position 160, the locking tab 152 of the display segment 14 is folded along the tab fold line 154 and inserted into the locking slot 156 in order to interlock with the locking slot 156.

When the display segment 14 is in the display position 160, the shelves 142 are exposed, since portion 24 of the display segment 14 is oriented along the same plane as the front wall 162 of the display 10. As a result, any product placed on the shelves 142 may be accessed by a user. Similarly, portion 20 of the display segment 14 is oriented along the same plane as the back wall 144 of the display. In addition, the front side 34 of the display segment 14 is exposed, which in turn displays the graphic 32.

Figure 12:
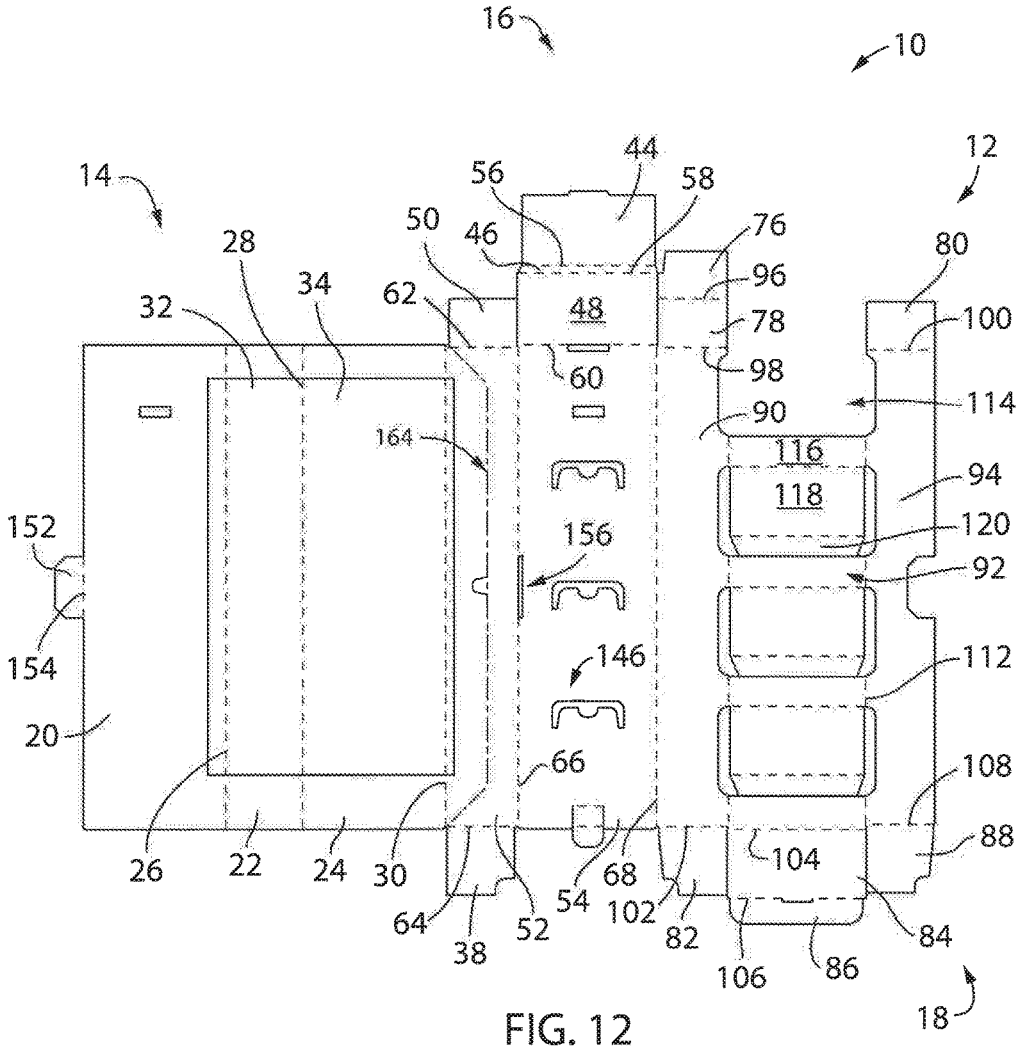
FIG. 12 is a side view of a one-piece sidekick display in an unfolded position, according to another embodiment of the invention.

Now referring to FIG. 12, an alternative embodiment of the invention is shown wherein the display segment 14 may be removed, e.g. via a perforation. As a result, display segment 14 acts simply as a removable enclosure for shipping. In this representative embodiment of the invention, the wall portion 52 includes a perforation 164. As shown in FIG. 12, the perforation 164 is disposed between fold lines 30, 66 and within the wall portion 52. While the representative embodiment of the invention shows the perforation 164 as starting at the top left corner of the wall portion 52 and ending at the bottom left corner of the wall portion 52, other embodiments of the invention may have the perforation 164 starting at any corner of the wall portion 52 and end at any corner of the wall portion 52.

As an alternative, display segment 14 may be removed, e.g. via a perforation along the fold line 30 between wall portions 34 and 52, subsequent to shipping in the event it is unnecessary or unneeded. In yet another alternative, display segment 14 may be removed, e.g. via a perforation along the fold line 66 between wall portions 52 and 54, subsequent to shipping.

Figure 13:
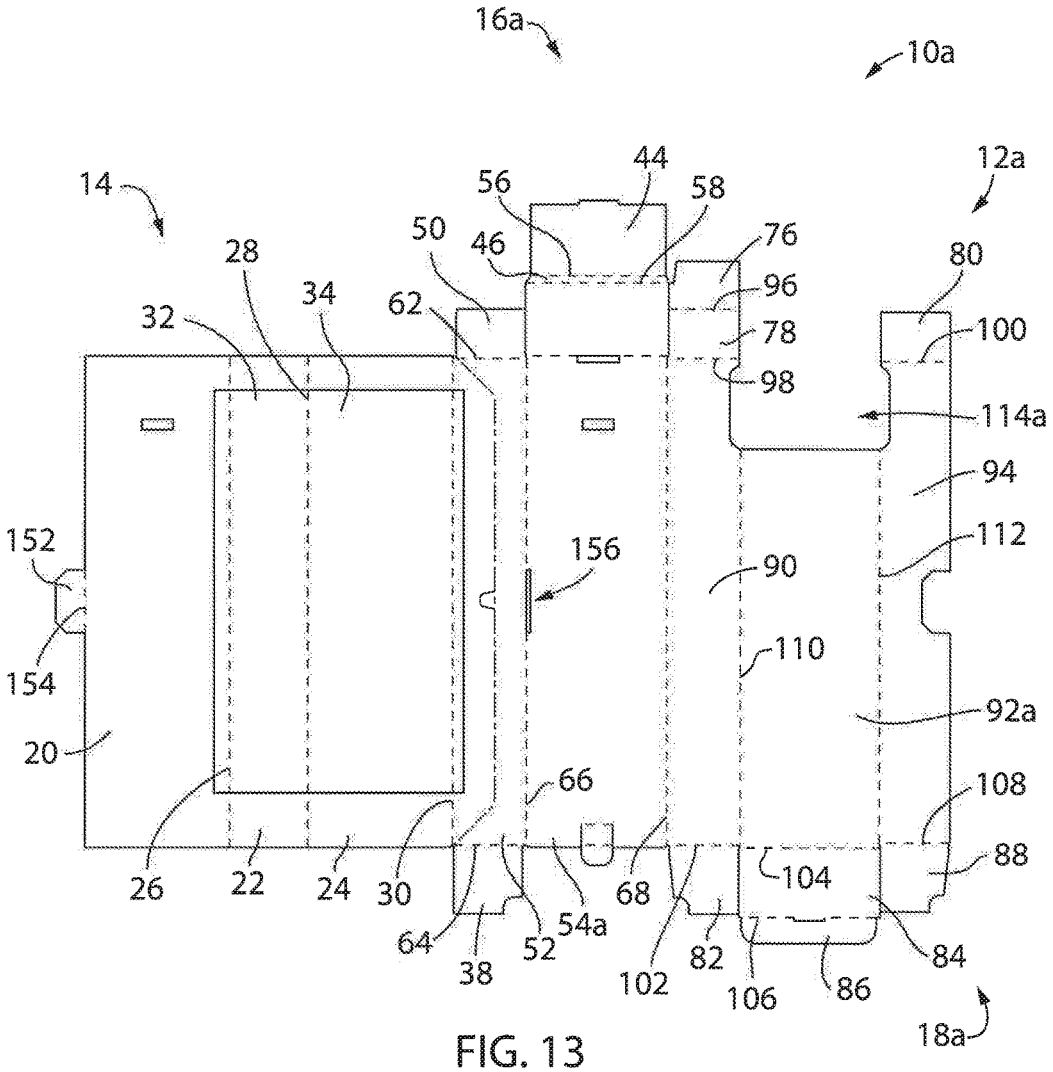
FIG. 13 is a side view of a one-piece sidekick display in an unfolded position, according to yet another embodiment of the invention.

FIG. 13 shows a modified sidekick display 10*a* in an unfolded position 12*a*, according to another embodiment of the invention. In this representative embodiment of the invention, the sidekick display 10*a* includes a modified wall segment 16*a* and a modified shelf segment 18*a* of the sidekick display 10 are modified to create a single shelf opening 114*a*. The modified wall segment 18*a* is similarly constructed to the wall segment 18 described above and shown in FIGS. 1-11. However, the modified wall segment 18*a*. does not include slots 146 formed in the second wall portion 54*a* of the wall segment 18*a*. The modified shelf segment 18*a* includes one (1) shelf opening 114*a* disposed at or adjacent to the top of the second shelf portion 92*a*.

While FIG. 13 illustrates the use of perforation 164 as described above with respect to FIG. 12 and its alternatives, it is contemplated that other embodiments of the modified sidekick display 10*a* may or may not include the perforation 164.

Figure 14:
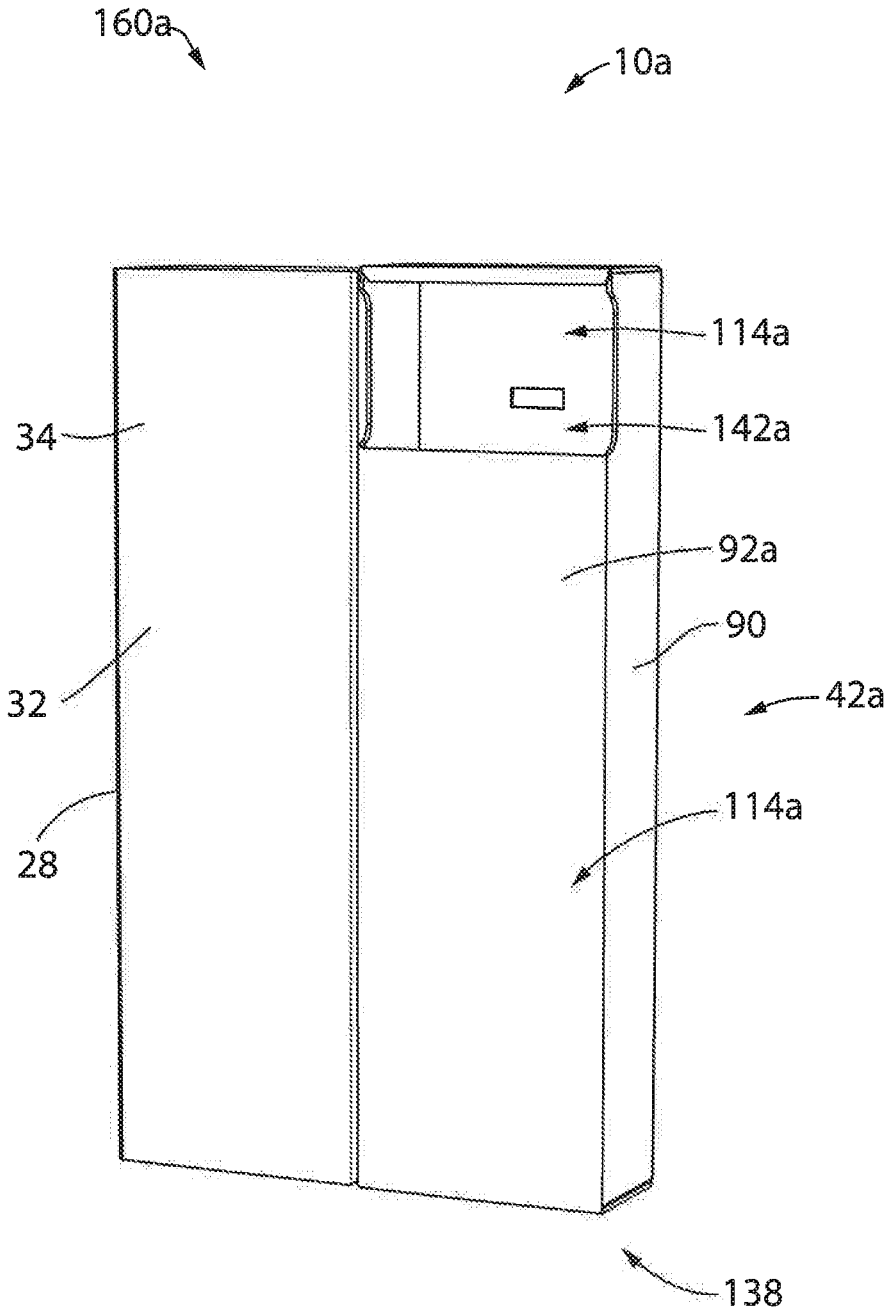
FIG. 14 is a front perspective view of the one-piece sidekick display of FIG. 13 in a display orientation.

FIG. 14 illustrates the modified sidekick display 10*a* with the wall segment 16*a* and the shelf segment 18*a*. in the folded position 42*a* and the display segment 14 in a display position 160. As seen in FIG. 14, the modified sidekick display 10*a* includes one (1) shelf opening 114*a* and a resulting one (1) shelf 142*a*. The shelf 142*a* extends from. the top of the sidekick display 10*a* to a location at or above the bottom of the sidekick display 10*a*. As a result, the shelf 142*a* is the form of a chute which can store a large number of products provided in a stack or mound and accessible from the one (1) shelf opening 114*a*.

While the representative embodiments of the invention describe folds along the fold lines being at 90 degree angles or approximately 180 degree angles, it is contemplated that other embodiments of the invention may be folded at any angle.

It should be understood that the above description, while indicating representative embodiments of the present invention, is given by way of illustration and not of limitation, Many changes and modifications may be made within the scope of the present invention without departing from the spirit thereof, and the invention includes all such modifications.

Various additions, modifications, and rearrangements are contemplated as being within the scope of the following claims, which particularly point out and distinctly claim the subject matter regarding as the invention, and it is intended that the following claims cover all such additions, modifications, and rearrangements.

I claim:

1. A display comprising:

a front wall;

a back wall oriented parallel to the front wall;

a plurality of sidewalls disposed between the front wall and back wall and connected thereto:

wherein the front wall, the back wall and the plurality of sidewalls cooperate to form a container defining an interior; and a display segment coupled to one of the front wall, back wall and plurality of sidewalls and transitionable between a display position and a shipping position different from the display position, wherein the display segment comprises a first display panel having an inner end that is movably secured to one of the front wall, back wall and sidewalls, and an outer end with which one or more additional display panels are interconnected, wherein the one or more additional display panels extend from the outer end of the first display panel, wherein the panels of the display segment in the shipping position are in a first configuration relative to each other and are engaged with one of the front wall, the back wall and the sidewalls in a manner that prevents access to the interior of the container, and in the display position are in a second configuration relative to each other, different from the first configuration, and are engaged with one of the front wall, the back wall and the sidewalls in a manner that allows access to the interior of the container.

2. The display of claim 1 wherein the one or more additional display panels of the display segment comprises a second display panel that is moveably interconnected with the first display panel and a third display panel that is movably interconnected with the second display panel, wherein when the display segment is in the shipping position and the panels of the display segment are in the first configuration relative to each other, the first, second and third display panels overlie walls of the container, and when the display segment is in the display position and the panels of the display segment are in the second configuration relative to each other, the first, second and third display panels form a display structure interconnected with and located adjacent the container and the first and third display panels are engaged with one or more of the front wall, the back wall and the sidewalls in a manner that allows access to the interior of the container.

3. A display comprising:

a front wall;

a back wall oriented parallel to the front wall;

a plurality of sidewalls disposed between the front wall and back wall and oriented perpendicular thereto; and a display segment coupled to one of the plurality of sidewalls and transitionable between a display position and a shipping position, wherein the display segment comprises a first portion, a second portion, and a third portion wherein in the shipping position the first portion is oriented parallel to and is in contact with the front wall, the second portion is oriented parallel to and is in contact with one of the plurality of side walls, and the third portion is oriented parallel to and is contact with the back wall.

4. The display of claim 2 wherein in the display position the first display panel is oriented in a plane parallel to a plane of the front wall, the third display panel is oriented in a plane parallel to a plane of the back wall, and the second display panel is disposed between the first and third display panels and oriented perpendicular thereto.

5. The display of claim 1 further comprising a graphic disposed on a first side of the display segment.

6. The display of claim 5 wherein the graphic is displayed when the display segment is in the display position.

7. The display of claim 1 wherein the display segment is removably coupled to one of the plurality of sidewalls by way of a perforation.

8. A blank, for a display comprising:

a wall segment comprising a plurality of wall portions;

a display segment comprising a plurality of display panel portions, the display segment extending from the wall segment and separated from the wall segment by way of a display fold line between one of the display panel portions and one of the wall portions;

a shelf segment comprising a plurality of portions, the shelf segment extending from the wall segment and separated from the wall segment by way of a shelf segment fold line;

wherein the plurality of wall portions of the wall segment form a back wall and at least one side wall of the display;

wherein the plurality of portions of the shelf segment form a front wall, at least one side wall, and at least one shelf of the display, wherein the back wall, the front wall and the side walls of the display form a container defining an interior, and wherein the at least one shelf is located within the interior of the container; and wherein the plurality of display panel portions of the display segment are transitionable between a display position and a shipping position different from the display position, wherein the display panel portions comprise a first display panel having an inner end that is movably secured to one of the front wall, back wall and sidewalls, and an outer end with which one or more additional display panels are interconnected, wherein the one or more additional display panels extend from the outer end of the first display panel, wherein the panels of the display segment in the shipping position are in a first configuration relative to each other and are engaged with one of the front wall, the back wall and the sidewalls in a manner that prevents access to the interior of the container, and in the display position are in a second configuration relative to each other, different from the first configuration, and are engaged with one of the front wall, the back wall and the sidewalls in a manner that allows access to the interior of the container.

9. The blank of claim 8 wherein the first display panel of the display segment is oriented to be an exterior side of the display segment when the display segment is in the display position; and wherein a second display panel of the display segment is oriented to be the exterior side of the display segment when the display segment is in the shipping position.

10. The blank of claim 9 further comprising a graphic disposed on the first display panel of the display segment.

11. The blank of claim 8 further comprising a perforation for selectively decoupling the display segment from the container.

12. The blank of claim 11 wherein the perforation is formed at at least one of the display fold line and a location within a portion of the display segment.

13. The blank of claim 8 wherein a first display panel of the display segment is oriented along a plane parallel to a plane of the front wall, a third display panel of the display segment is oriented along a plane parallel to a plane of the back wall, and a second display panel of the display segment is disposed between the first and third display panels when the display segment is in the display position.

14. A blank for a display comprising:

a wall segment comprising a plurality of portions;

a display segment comprising a plurality of portions, the display segment extending from the wall segment and separated from the wall segment by way of a display fold line;

a shelf segment comprising a plurality of portions, the shelf segment extending from the wall segment and separate from the wall segment by way of a shelf fold line;

wherein the plurality of portions of the wall segment form a back wall and at least one side wall of the display;

wherein the plurality of portions of the shelf segment form a front wall, at least one side wall, and at least one shelf of the display; and wherein the plurality of portions of the display segment are transitionable between a display position and a shipping position, wherein when the display segment is in the shipping position, a first portion of the plurality of portions of the display segment is oriented parallel to and in contact with the front wall, a second portion of the plurality of portions of the display segment is oriented parallel to and in contact with one of the at least one side walls, and a third portion of the plurality of portions of the display segment is oriented parallel to and contact with back wall.

* * * * *